US005385180A

United States Patent [19]

Wittman

[11] Patent Number: 5,385,180

[45] Date of Patent: Jan. 31, 1995

[54] LIQUID SAVER FUNNEL SYSTEM

[75] Inventor: Boyd Wittman, Colorado Springs, Colo.

[73] Assignee: Empak, Inc., Chanhassen, Minn.

[21] Appl. No.: 257,533

[22] Filed: Jun. 9, 1994

[51] Int. Cl.[6] ..... B67C 11/00

[52] U.S. Cl. ..... 141/340; 141/339; 141/342; 141/309; 141/310; 141/106; 141/375; 141/363

[58] Field of Search ..... 141/331, 333, 339, 340, 141/341, 342, 343, 309, 310, 106, 375, 363, 364

[56] References Cited

U.S. PATENT DOCUMENTS

| | | | |
|---|---|---|---|
| 92,791 | 7/1869 | Burwell | 141/339 X |
| 2,250,910 | 7/1941 | Hiett | 141/106 |
| 2,703,670 | 3/1955 | Voight | 141/340 |
| 2,835,191 | 5/1958 | Clurman | 141/342 X |
| 3,211,195 | 10/1965 | Porter | 141/337 |
| 4,140,160 | 2/1979 | Glackin | 141/332 |
| 4,143,690 | 3/1979 | Dunicz | 141/333 |
| 4,698,861 | 10/1987 | Bogusz | 141/340 X |
| 4,789,017 | 12/1988 | Panasewicz | 141/342 |
| 4,804,026 | 2/1989 | Bailey | 141/340 |
| 4,832,095 | 5/1989 | Bonnell | 141/106 |
| 4,850,403 | 7/1989 | Wiese | 141/340 X |
| 5,123,461 | 6/1992 | Belokin, Jr. et al. | 141/98 |

*Primary Examiner*—Ernest G. Cusick
*Attorney, Agent, or Firm*—Haugen and Nikolai

[57] ABSTRACT

A spill inhibiting funnel system is described that has stepped fins and blades extending, respectively, from the outer and inner surfaces of a tapered funnel body. The fins allow the funnel to be variably positioned with respect to a receiving container's opening in a secure fashion to prevent spills. Likewise, the stepped blades allow a pouring container to be securely placed inside the funnel and remain there in an inverted upright or angled position.

4 Claims, 2 Drawing Sheets

LIQUID SAVER FUNNEL SYSTEM

BACKGROUND OF THE INVENTION

I. Field of the Invention

This invention relates generally to funnels, and more particularly, to a funnel that, without requiring manual manipulation, is capable of firmly resting over a receiving container's opening in an offset upright or angled-position with the funnel spout partially extending into the container's opening, while allowing a pouring container to rest inside the funnel in an inverted upright or angled position, thereby preventing tipping and spilling while minimizing the amount of required manual manipulation.

II. Discussion of the Prior Art

When using a funnel, it is desired to pour the contents from a pouring container into a funnel that is properly aligned with the receiving container opening with minimal amounts of manual manipulation of the funnel. Various funnels are disclosed in the prior art that allow the transfer of liquids from a pouring container into a receiving container. For example the Porter U.S. Pat. No. 3,211,195 is capable of being retained in an upright position, relative to the receiving container opening without manual manipulation. The Porter funnel has ridges formed on the tapered body of the funnel. These ridges engage with the lip of a receiving container opening, allowing the funnel to be positioned in an upright position without further manual manipulation. However, the Porter funnel must be centered within the receiving container's opening. Depending on the location of receiving container's opening, there are times when it is necessary to offset the center of the funnel from the center of the receiving container's opening. Further a pouring container can not rest against the Porter funnel's side without risk of tipping and spilling liquids. Therefore, a need exists to provide a funnel which firmly rests in an upright position offset from a receiving container opening, that allows a pouring container to rest inside the funnel.

The Wiese U.S. Pat. No. 4,850,403 describes a funnel system that has a lower coplanar surface extending perpendicular to the funnel axis to support the funnel above an appropriate sized receiving container's opening. It was suggested that the lower coplanar surface may contain magnetic material to aid in firmly positioning the funnel against an appropriately sized receiving container opening. The Wiese funnel does not suggest a need to offset the center of the spout from the center of the receiving container opening. Also, with the suggested lower coplanar surface of the Wiese funnel, the funnel cannot be firmly positioned against materials such as glass or plastic, without manual manipulation or an increased likelihood that the funnel will slip, causing a spill of the liquid being poured. Further, there are times when the funnel must be angled relative to the vertical axis of the receiving container's opening. The lower coplanar surface of the Wiese patent only allows the funnel vertical axis to be positioned parallel to the receiving container opening's vertical axis. Therefore, a need exists for a funnel that firmly rest in an upright or angled, offset position relative to the receiving container's opening made of materials other than a magnetically permeable material.

The Bailey U.S. Pat. No. 4,804,026 describes a funnel having straps for holding the funnel in an upright position. However, this funnel requires the smaller end of the funnel to project substantially into the receiving container's opening. In many instances, the receiving container is constructed such that a funnel spout may not protrude very far into the receiving container's opening. Therefore, there is a need for a funnel that will remain relatively upright without manual manipulation, and that does not project substantially into the receiving containers opening.

The Bonnell U.S. Pat. No. 4,832,095 describes a funnel having two different sized concentric rings attached to the inside of the tapered body. The concentric rings hold an inverted pouring container in place. The concentric rings require the pouring container's opening to be slightly smaller and conforming to the concentric ring. This conformity allows the concentric ring to hold the pouring container in place. The concentric rings do not allow the pouring container to be held in an angled position relative to the spout. Therefore, a need exists for a means to firmly hold a pouring container of varying sizes within the funnel, and at various angles relative to the spout.

At times, when using a funnel, the receiving container's opening is positioned such that a large funnel may not be used. It also may be desired to position an oblong pouring container within the funnel in an inverted upright position. Either an oblong funnel or a larger funnel is needed to avoid requiring manual manipulation. Therefore, a further need exists to provide a funnel that allows oblong containers to be positioned within the funnel without requiring a larger funnel.

The present invention overcomes these disadvantages and meets the present needs by providing a funnel system that allows the spout to be offset relative to the center of the receiving container opening without requiring manual manipulation. The invention also allows a pouring container to rest inside the funnel in an upright or angled inverted position offset from the spout. This further decreases the amount of required manual manipulation and also decreases the likelihood of liquid spills. The present funnel system may also be used in an upright position even in cases where the receiving container's opening does not allow the spout to project substantially into the container's opening.

SUMMARY OF THE INVENTION

The purpose of the present invention is to provide a funnel that can be positioned in an offset upright or angled position relative to the receiving container's opening, and used with minimal manual manipulation. It is also a purpose of the present invention to allow a pouring container to be positioned in an upright or angled, inverted position inside the funnel without increasing the risk of tipping or spilling liquids. The funnel has an annular, elliptic or oblong tapered body or side having a wide open top end and a narrow bottom end. The spout forms a narrow open bottom end. Fins extend from the tapered body, providing a means to offset the funnel from the center of the receiving container's opening in an upright position. Stepped fins also allow the funnel to be positioned at various angles relative to the planar surface of the receiving container's opening.

The fins also prevent the outside tapered surface of the funnel from completely contacting the receiving container's opening, thereby creating an air space. This air space allows a quicker transfer of liquid from the pouring container to the receiving container.

The inside of the tapered body has stepped blades extending inward and downward toward the narrow open end. These blades allow the pouring container to be placed inside the funnel and remain there in an inverted upright or angled position. The blades also allow the pouring container's opening to be offset relative to the spout opening. This ability to offset the pouring container prevent's an uneven gravitational force to the side of the funnel, by the pouring container, causing the funnel to tip and spill the liquid from the pouring container. The blades further provide a gripping surface preventing the pouring container from slipping inside the funnel, thereby further preventing liquid spills.

It is accordingly a principal object of the present invention to provide a funnel that may be firmly positioned in an offset upright position relative to the receiving container's opening.

Another object of the present invention is to eliminate the need to center the funnel in the pouring container opening.

A further object of the present invention is to prevent the outside surface of the funnel from forming an airtight seal around the opening of the receiving container, thereby allowing quicker transfer of liquid from the pouring container to the receiving container.

Yet another object of the present invention is to provide a funnel that decreases the likelihood of tipping and liquid spills when a pouring container is positioned inside the funnel.

Still a further object of the present invention is to allow an oblong container to be positioned within the funnel, without requiring a larger funnel diameter.

Yet another object of the present invention is to prevent the funnel and pouring container from tipping, when the receiving container does not allow the funnel to extend substantially into the receiving container's opening.

Another object of the present invention is to allow the funnel to be firmly positioned at various angles relative to the receiving container opening without requiring manual manipulation.

These and other objects, as well as the features and advantages of the present invention, will be readily apparent to those skilled in the art from a review of the following detailed descriptions of the preferred embodiment in conjunction with the accompanying drawings and claims.

DETAILED DESCRIPTION OF THE PREFERRED EMBODIMENT

Figure 1:
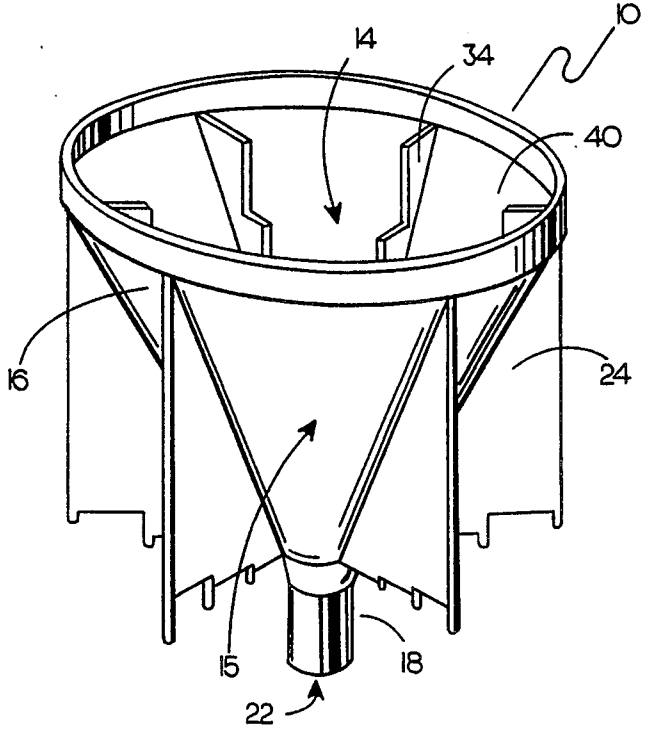
FIG. 1 is a perspective view of an oblong funnel.
Figure 4:
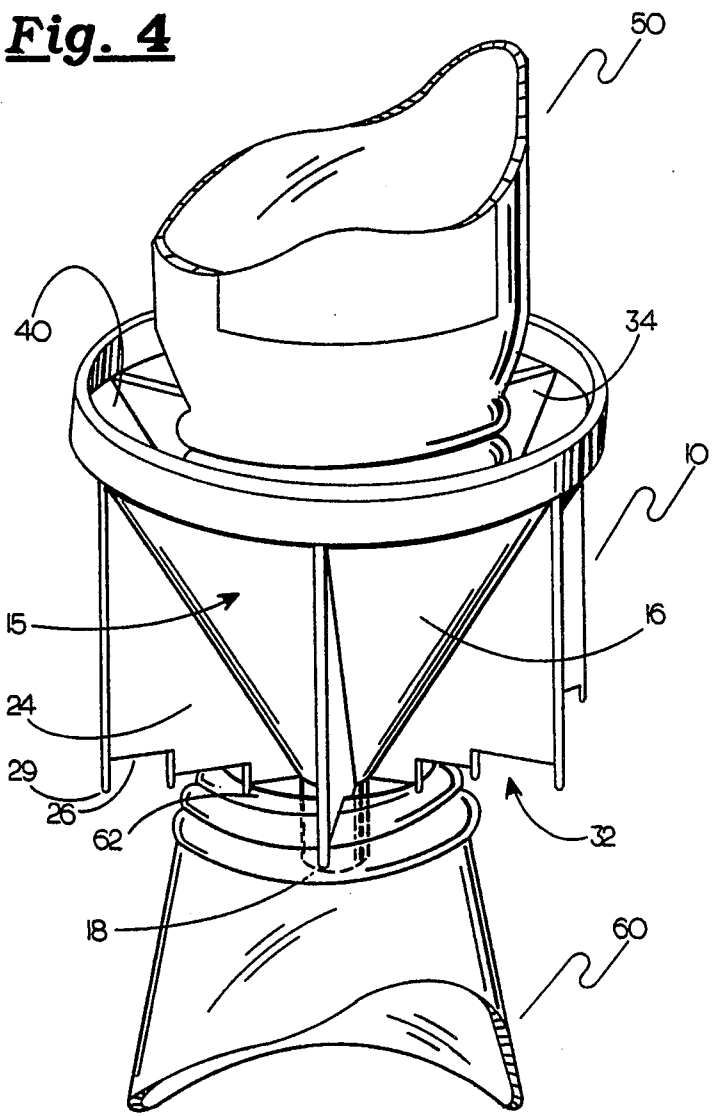
FIG. 4 is a partial perspective view of an annular funnel positioned in an offset upright position relative to a receiving container, and a pouring container in an upright position relative to the funnel.

Referring first to FIG. 1, there is shown generally a funnel 10 having an open wide top end 14, a tapered body 15 having an outer surface 16, an inner surface 40, and a spout 18 forming a narrow open end 22. The tapered body 15 may be oblong or annular (see FIGS. 1 and 4). Referring again to FIG. 1, a plurality of fins 24 extend from the outer surface 16 allowing the spout 18 to be placed in an offset position from the center of a receiving container's opening while the funnel 10 remains in an upright position. The fins 24 also keep the outer surface 16 from engaging with the receiving container's opening 62, thereby, impeding the outer surface 16 from forming an airtight contact around the receiving container's opening (see FIG. 4).

Figure 3:
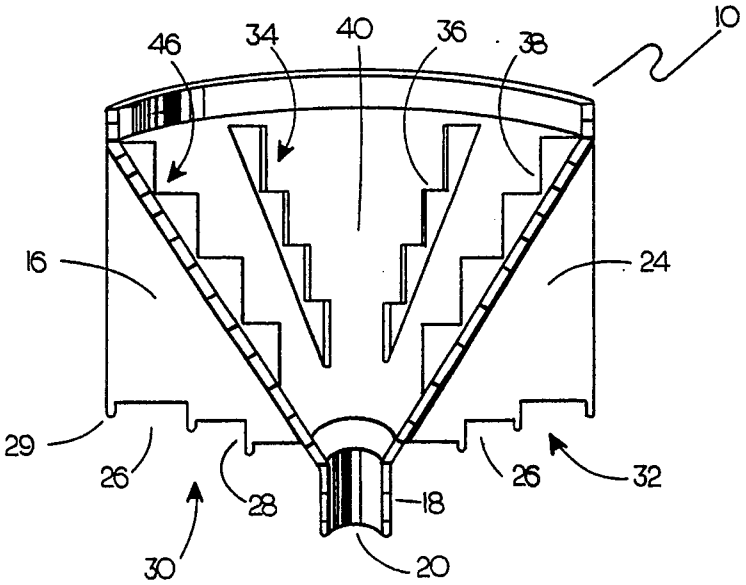
FIG. 3 is a sectional perspective view of a funnel of the type shown in FIG. 1.
Figure 5:
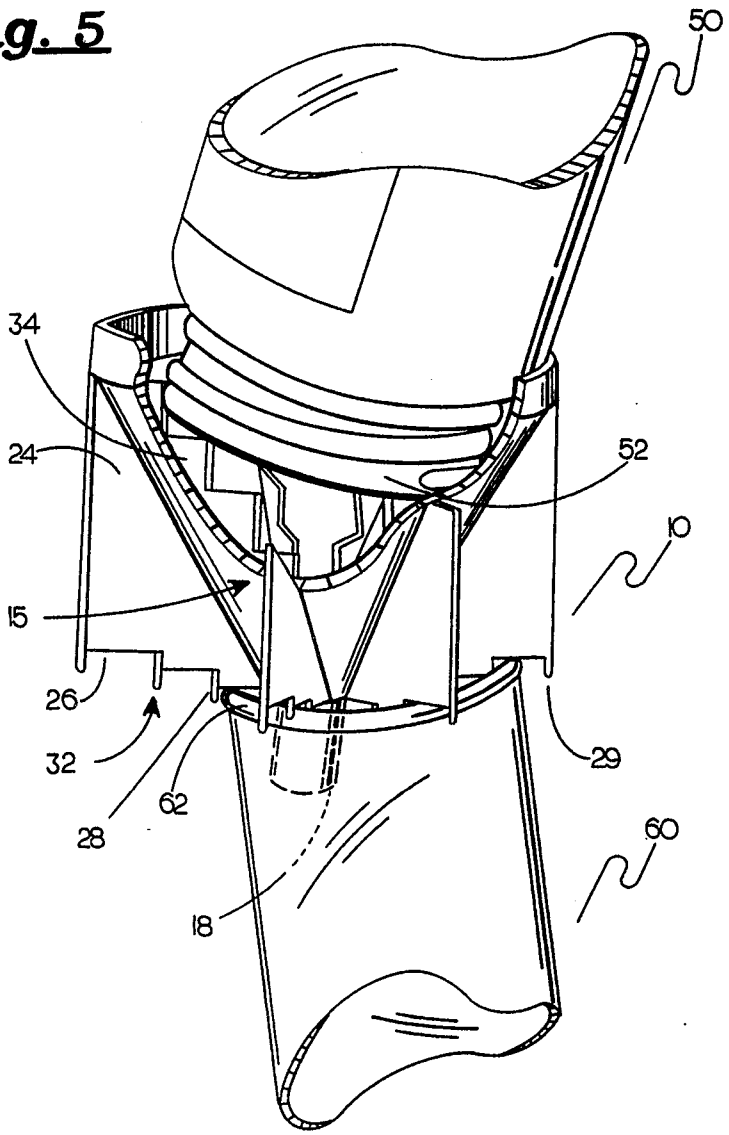
FIG. 5 is a partial perspective view of a sectioned funnel at an angled relative to the pouring container, and the pouring container angled relative to the funnel.

Referring to FIG. 3, the fins 24 extend downward toward the spout 18. The fins lower edge 30 is formed by a plurality of offset planar surfaces 26. Each planar surface 26 of each fin 24 is offset by a vertical support surface 28. The offset planar surfaces 26 forms a step 32 that extends upward and outward from the outer surface 16. The steps 32 of the plurality of fins 24 forms a relatively annular planar surface relative to each step. The fin's 24 offset planar surface 26 is relatively parallel to the spout bottom planar surface 20. The steps 32 engage with the receiving container's opening 62, retaining the funnel 10 in the desired (offset) position (see FIG. 4). The relatively annular planar surfaces of the step 32 may be aligned parallel or at various angles relative to the receiving container opening's 62 planar surface (see FIG. 5).

Each step 32 has a retaining peg 29. The retaining peg 29 extends from each offset planar surface 26 at the intersection of the planar surface 26 and the vertical surface 28. When the funnel 10 is positioned at varying angles relative to the receiving container's opening 62, the vertical support surface 28 and the retaining pegs 29 firmly retain the funnel 10 in the desired position (see FIG. 5). The vertical support surface 28 supports the funnel 10 by engaging with the receiving container opening 62 The retaining peg 29 engages with the receiving container opening 62, retaining the funnel in an offset position. Also, the retaining pegs 29 help prevent the funnel 10 from slipping off different sized receiving containers 60. Of course, the fins 24 may have notches or other varying geometric shapes to form stepped relatively planar support surfaces without deviating from the invention.

Figure 2:
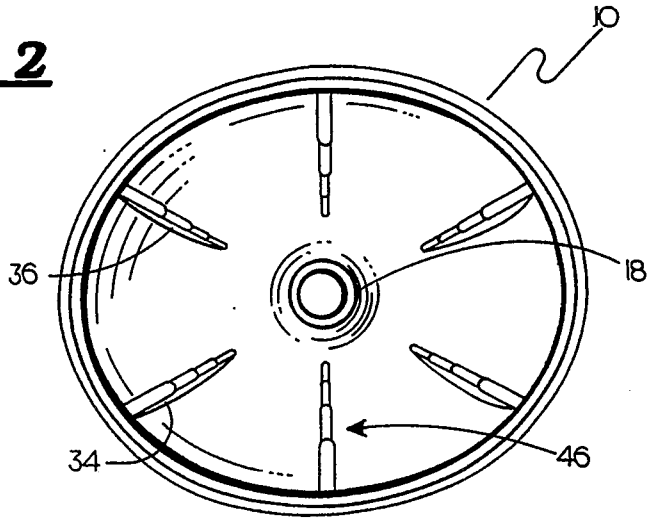
FIG. 2 is a perspective plan view of a funnel of the type shown in FIG. 1.

The funnel 10 inner surface 40 has a plurality of blades 34 extending inward and downward toward the spout 18 (see FIGS. 2 and 3). The blades 34 have a plurality of horizontal surfaces 36. The horizontal surfaces 36 of the blade 34 are offset by a vertical support surface 38. These offset horizontal surfaces 36 of each blade 34 form interior steps 46 that extend inward and downward toward the spout 18. The interior steps 46 provide a gripping surface that prevents the pouring container 50 from slipping, when placed inside the funnel. The interior steps 46 slope relatively parallel to the inner surface 40 of the funnel 10. The plurality of the blades horizontal surfaces 36 align with respect to each other forming various planar levels. The various planar levels support the pouring container 50 in an upright or angled position, allowing the pouring container 50 to rest in the funnel 10 without requiring manual manipulation (see FIGS. 4 and 5). The various planar levels also allows various sized pouring containers 50 to be offset relative to the spout 18 narrow end 22. Of course, the interior steps 46 may have varying geometric shapes without deviating from the invention.

There are at least three fins 24 that provide the funnel with stability when resting on the receiving container opening 62. At least three blades 34 provide stability to the pouring container 50, without requiring manual manipulation. This stability allows the pouring container 50 to be positioned in an inverted, upright or angled alignment relative to the funnel 10 and receiving container 60 (see FIGS. 4 and 5). The funnel 10 may have a tapered side or body 15 shaped in an elliptic or oblong tapered shape. The elliptic or oblong tapered shape of the funnel 10 allows an oblong container to be positioned within the funnel along the axis of the ellipse. The elliptic tapered shape allows the distance between the sides along the ellipse's y-axis, through the origin of the ellipse, to be less than the diameter of a similar tapered annular funnel having the same height (see FIG. 2). Therefore, an elliptic or oblong funnel may be used in a confined area where the diameter of the tapered annular funnel would be too large.

Having described the constructional features of the funnel 10, the mode of use will now be discussed. The user places the spout 18 into the opening of the receiving container. The opening in the receiving container may be in a position making it difficult for the funnel to remain in an upright position without offsetting the center of the spout from the center of the receiving container's opening. When this is the case, the operator may align the spout 18 in an offset position from the receiving container open end. The stepped fins 24, vertical support surface 28 and retaining pegs 29 allow the funnel to remain in an upright offset position or other alignment (either centered or angled) relative to the receiving container's opening.

The operator may then position the pouring container inside the funnel 10, through the wide open end 14, in a relatively inverted, upright or angled position. The pouring container's opening may be offset relative to the spout 18 center opening. The stepped blades 34 on the inner tapered surface 40 of the funnel 10 provide a gripping surface preventing various sized inverted pouring containers 50 from slipping and further provides an interior step 46 for the container to rest on. This allows the operator to position the pouring container 50 within the funnel 10 allowing the contents to drain into the funnel 10 without further manual manipulation or risk of tipping and spilling liquids. The concentric tapered surface 16 may further form an elliptic cross-section or oblong cross-section, thereby allowing oblong containers to be positioned within the funnel 10 without requiring a larger inner surface 40.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed:

1. A funnel system for the prevention of excess liquid spillage when pouring liquids from a pouring container having an open end, into a receiving container haning an open end comprising:

(a) a tapered annular body having an open wide top end, an open narrow bottom end, an outer surface and an inner surface;

(b) a spout forming said open narrow bottom end;

(c) an external support means for firmly positioning the funnel such that said spout may be offset with respect to the open end of the receiving container; wherein said external support means comprises a plurality of fins extending outwardly from said outer surface of said tapered annular body, each of said fins having bottom offset horizontal surfaces forming steps such that said steps supports said funnel such that said spout is aligned with the open end of the receiving container, wherein some of said steps of said plurality of fins form a relatively annular planar surface relative to each of said steps; and (d) an internal support means for firmly positioning an inverted pouring container relative to said spout of the funnel; said internal support means comprises a plurality of blades extending inward from said inner surface of said tapered annular body, each of said blades having offset horizontal surfaces forming internal steps, such that said internal steps supports the pouring container.

2. A funnel system for the prevention of excess liquid spillage when liquids from a pouring container having an open end, into a receiving container having an open end comprising:

a tapered annular body having an open wide top end, an open narrow bottom end, an outer surface and an inner surface;

(b) a spout forming said open narrow bottom end;

(c) an external support means for firmly positioning the funnel such that said spout may be offset with respect to the open end of the receiving container; and (d) an internal support means for firmly positioning an inverted pouring container relative to said spout of the funnel, wherein said internal support means comprises a plurality of blades extending inward from said inner surface of said tapered annular body, each of said blades having offset horizontal surfaces forming internal steps, such that said internal steps supports the pouring container.

3. A funnel system for the prevention of excess liquid spillage when pouring liquids from a pouring container having an open end, into a receiving container having an open end comprising:

(a) a tapered oblong body having an open wide top end, an open narrow bottom end, an outer surface and an inner surface;

(b) a spout forming said open narrow bottom end;

(c) an external support means for firmly positioning the funnel such that said spout may be offset with respect to the open end of the receiving container; and (d) an internal support means for firmly positioning an inverted pouring container relative to said spout of the funnel; wherein said internal support means comprises a plurality of blades extending inward from said inner surface of said tapered oblong body, each of said blades having offset horizontal surfaces forming internal steps, such that said internal steps supports the pouring container.

4. A funnel system for the prevention of excess liquid spillage when pouring liquids from a pouring container having an open end, into a receiving container having an open end comprising:

(a) a tapered oblong body having an open wide top end, an open narrow bottom end, an outer surface and an inner surface;

(b) a spout forming said open narrow bottom end;

(c) an external support means for firmly positioning the funnel such that said spout may be offset with respect to the open end of the receiving container: wherein said external support means comprises a plurality of fins extending outwardly from said outer surface of said tapered oblong body, each of said fins having bottom offset horizontal surfaces forming steps such that said steps supports said funnel, said spout being aligned with the open end of the receiving container, wherein some of said steps of said plurality of fins form a relatively annular planar surface relative to each of said steps; and (d) an internal support means for firmly positioning an inverted pouring container relative to said spout of the funnel; said internal support means comprises a plurality of blades extending inward from said inner surface of said tapered oblong body, each of said blades having offset horizontal surfaces forming internal steps, such that said internal steps supports the pouring container.

* * * * *